United States Patent [19]

Minor

[11] Patent Number: 4,522,542

[45] Date of Patent: Jun. 11, 1985

[54] APPARATUS FOR PRODUCING FINISHED BOOKLETS

[75] Inventor: James C. Minor, Rochester, N.Y.

[73] Assignee: Eastman Kodak Company, Rochester, N.Y.

[21] Appl. No.: 484,068

[22] Filed: Apr. 11, 1983

[51] Int. Cl.[3] ..... B42C 1/00; B42C 3/00; B42C 19/00

[52] U.S. Cl. ..... 412/25; 412/14; 412/22

[58] Field of Search ..... 271/291; 414/43, 52, 414/54, 171; 412/22, 25, 14; 270/58; 355/145 H

[56] References Cited

U.S. PATENT DOCUMENTS

| | | | |
|---|---|---|---|
| 3,630,607 | 12/1971 | Korn et al. . | |
| 3,709,595 | 1/1973 | Turner et al. . | |
| 4,134,672 | 1/1979 | Burlew et al. . | |
| 4,248,525 | 2/1981 | Starrett | 355/145 H |
| 4,293,214 | 10/1981 | George et al. | 414/54 |
| 4,295,733 | 10/1981 | Janssen et al. | 355/145 H |
| 4,358,197 | 11/1982 | Kukucka et al. . | |
| 4,372,201 | 2/1983 | Dudziak et al. | 414/43 |
| 4,376,529 | 3/1983 | George et al. . | |
| 4,382,592 | 5/1983 | Harding et al. | 414/54 |
| 4,385,827 | 5/1983 | Naramore . | |
| 4,444,491 | 4/1984 | Rinehart et al. . | |
| 4,473,425 | 9/1984 | Baughman et al. | 156/356 |

OTHER PUBLICATIONS

Research Disclosure Item No. 22733, Mar. 1983, pp. 120–134.

Xerox 9900 News Release (Mar. 6, 1984).

Rochester Times Union, Tuesday Evening, Mar. 6, 1984, (New "Top" Xerox Copier).

*Primary Examiner*—Paul A. Bell

*Assistant Examiner*—Paul M. Heyrana, Sr.

*Attorney, Agent, or Firm*—G. Herman Childress

[57] ABSTRACT

Apparatus for producing finished booklets from a plurality of sheets includes an assembly station where a set of sheets are assembled together to form a booklet and a collection station for receiving booklets produced in the assembly station. A door on the apparatus is ordinarily closed to limit access by an operator to the assembly station and the collection station during operation of the apparatus. The door is opened for removal of assembled booklets from the collection station. A passage is provided for delivering a booklet from inside the apparatus to a position where the booklet is accessible from the outside of the apparatus. A booklet can be engaged after it is assembled in the assembly station and delivered through the passage to the outside of the apparatus where it can be examined by the operator during production of additional booklets. By obtaining a booklet in this manner, and without opening the door, the operator is not exposed to the mechanical and electrical mechanisms of the apparatus.

15 Claims, 5 Drawing Figures

APPARATUS FOR PRODUCING FINISHED BOOKLETS

BACKGROUND OF THE INVENTION

This invention relates to apparatus for producing finished booklets from a plurality of sheets and, more particularly, to such apparatus adapted to deliver a finished booklet to an operator accessible location outside the apparatus instead of delivering the booklet to a collection station inside the apparatus.

It is known to provide copier/duplicators with finishing apparatus to enable production of one or more finished booklets from a multi-page original document with the booklets being delivered stacked in a pile or on a tote tray. See, for example, U.S. Pat. No. 3,709,595, which issued on Jan. 9, 1973 in the names of L. H. Turner et al, and commonly assigned U.S. Pat. No. 4,134,672, which issued on Jan. 16, 1979 in the names of L. E. Burlew et al. Such patents disclose the production of booklets from sets of copy sheets produced by a copier/duplicator. The booklets can be either stapled or unstapled, and stacked either in alignment or offset from each other when delivered to a collection station. Commonly assigned U.S. Pat. No. 4,473,425, issued on Sept. 25, 1984 from patent application Ser. No. 380,966, filed May 24, 1982 in the names of R. C. Baughman et al and entitled BINDING APPARATUS AND METHOD relates to apparatus for forming booklets from sets of copies received from a duplicator either by stapling the sheets of a set together as, for example, disclosed in U.S. Pat. No. 4,134,672, or, alternatively by using a liquid adhesive to bind adjacent sheets of the set together.

Copier/duplicators with finishing apparatus as disclosed in the patents and application referred to above may be used to produce many booklets with each booklet comprising many sheets. When the apparatus is used for relatively long production runs, the operator may wish to obtain the first booklet produced, or some subsequent booklet produced, before the job run is completed. This permits the operator either to check the operation of the apparatus or to provide one booklet quickly for delivery to the person ordering the booklets. This need can be satisfied by providing an opening in the apparatus through which the operator can manually remove a booklet from a station in the apparatus where finished booklets are collected. Such an opening is shown in FIG. 1 of U.S. Pat. No. 4,134,672. However, if the operator has unrestricted access to the areas of the finisher where the copy sets are produced and delivered, there is a possibility that the operator would be exposed to potentially hazardous situations involving operation of the mechanical and/or electrical parts of the finisher. Such situations can be avoided by providing an access door or cover that is interlocked such that the finisher is stopped when the door or cover is opened. In this regard, reference is made to the description beginning in column 12 at lines 53 of the beforementioned U.S. Pat. No. 3,709,595 which describes a solenoid operated lock mechanism for holding the cover of the finisher apparatus locked until completion of a job. While such apparatus may provide adequate protection for the operator, it also prevents the operator from obtaining a copy of the first booklet produced, or some other subsequently produced booklet, during the production run without stopping the apparatus.

Another alternative is for the operator to first program the machine to produce a single booklet, to inspect that booklet and then proceed with production of additional booklets as required. This is not only more time consuming and reduces productivity of the apparatus, but also is not desireable because the apparatus requires less maintenance when it is used primarily for relatively long production runs.

The apparatus of the present invention eliminates the problems associated with customer access to the mechanical and/or electrical apparatus of the finishing apparatus but still allows the operator to obtain one finished booklet from the apparatus without stopping a long production run.

SUMMARY OF THE INVENTION

The present invention relates to an improvement in apparatus for receiving a plurality of sheets and producing booklets. Such apparatus has an assembly station where a set of sheets are assembled together to form a booklet, and a collection station for receiving booklets from the assembly station. The apparatus also has means for limiting access by an operator to the assembly station and the collection station during operation of the apparatus. The improvement comprises means defining a passage for a booklet from inside the apparatus to a position where the booklet is accessible from outside the apparatus. The invention further comprises means for engaging a booklet after it is assembled in the assembly station and for delivering the booklet into the passage.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

Figure 1:
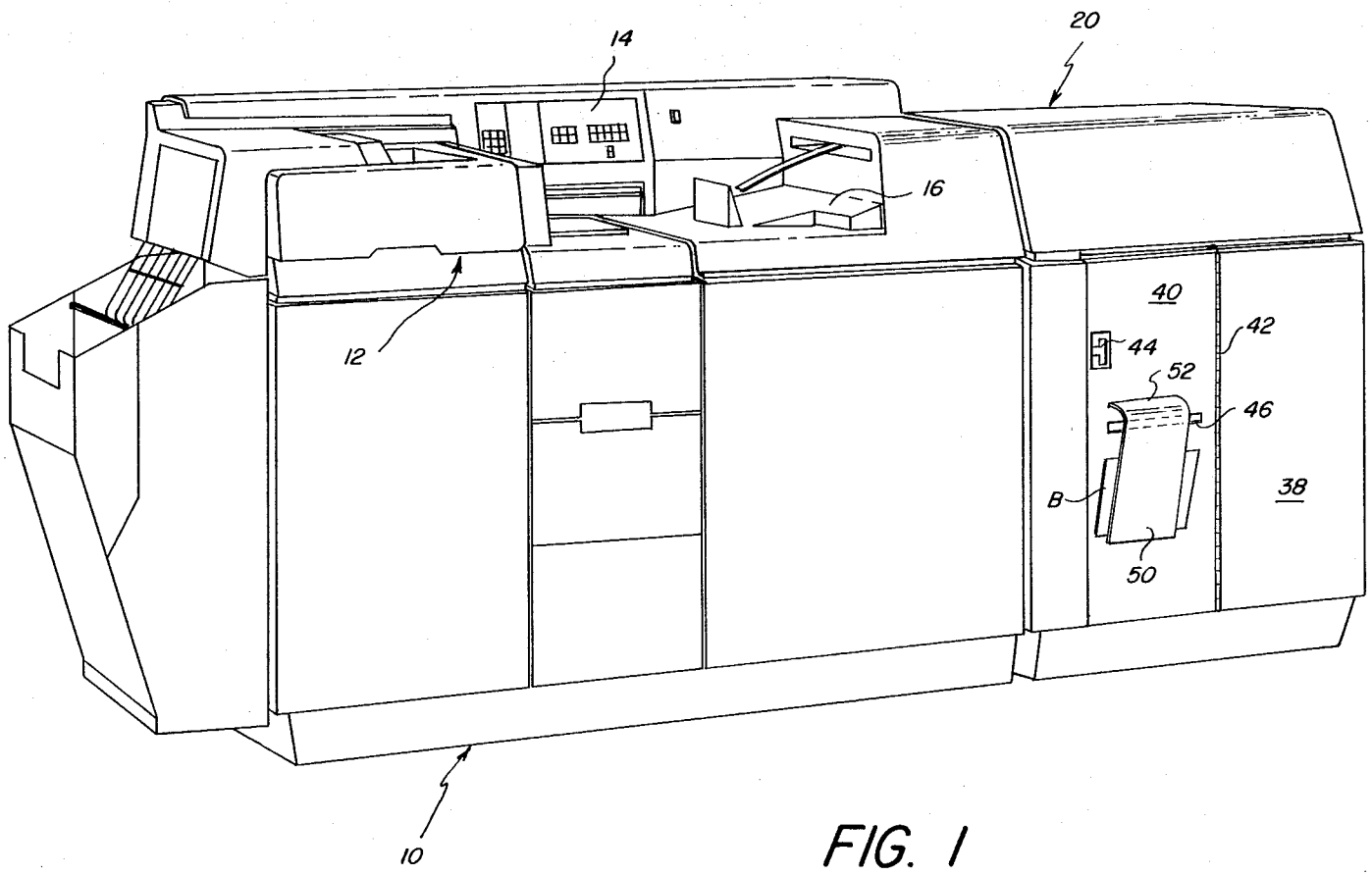
FIG. 1 is a perspective view of the improved finishing apparatus of the present invention illustrated in combination with a copier/duplicator having a recirculating feeder.

Referring now to FIG. 1 of the drawings, a copier/duplicator generally designated 10 has a recirculating feeder 12 that receives a stack of document sheets and circulates the sheets seriatim to an exposure position beneath the feeder where each sheet is exposed once to make a copy thereof, and then returns the sheet to the top of the stack in the feeder. It is known to provide control means for a copier/duplicator in the form of a programmable logic and control unit. A machine operator can program the copier/duplicator for various modes of operation by means of an operator control panel 14. Copies produced by the copier/duplicator can be delivered either to an output tray 16 or to finisher apparatus generally designated 20. Finisher 20 is coupled to the copier/duplicator either as an accessory or as an integral portion of the machine. The finisher can be controlled from the logic and control unit, or other control apparatus, for the duplicator, or the finisher can be provided with its own control apparatus. The combination of a duplicator, recirculating feeder and stapler type finisher as generally shown in FIG. 1 is disclosed in more detail in the beforementioned commonly assigned U.S. Pat. No. 4,134,672, the disclosure of which is incorporated herein by reference.

Figure 2:
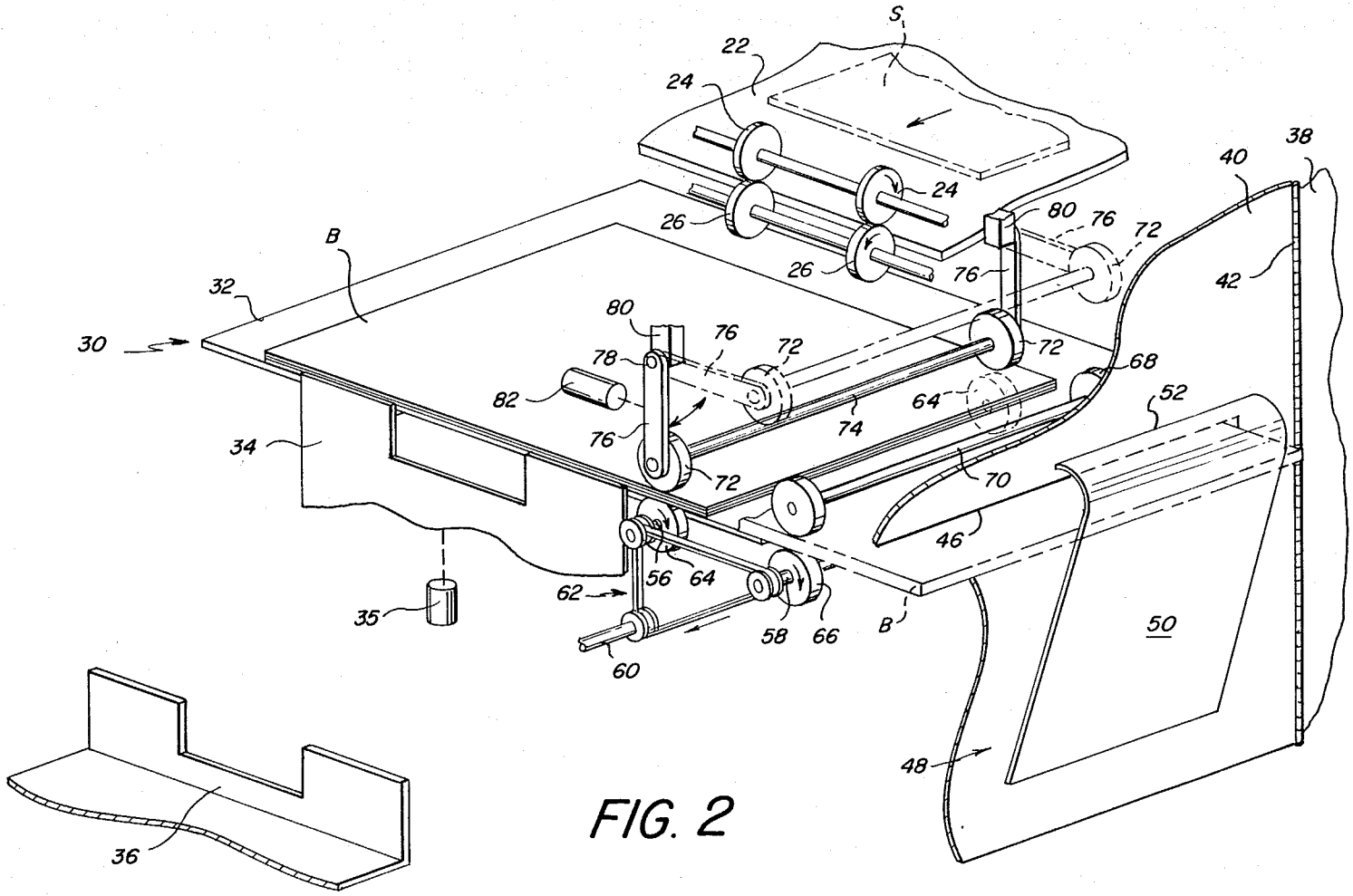
FIG. 2 is an enlarged, fragmentary view of one embodiment of the apparatus of the present invention wherein a booklet formed from a copy set is fed directly from an assembly tray to a position outside the finisher.

Referring now to FIG. 2, a sheet S delivered to finisher 20 by duplicator 10 is directed along a sheet path by guide means, including a sheet guide 22, which directs the sheet into the nip between pairs of rollers 24, 26. In this manner each sheet of a set of sheets is delivered into an assembly station generally designated 30. Station 30 includes a tray 32 and a gate 34 located at the side edge of the tray opposite from the guide 22 and rollers 24, 26. Gate 34 normally projects above the surface of tray 32, but can be lowered by a pneumatic cylinder 35 to facilitate removal of a booklet from the tray. The sheets received in the tray 32 are jogged into alignment with each other by side and edge joggers, not shown. In this manner a booklet B is formed from the set of sheets delivered into in the tray 32. The booklet B thus comprises a plurality of sheets S which are aligned with each other. The booklet may be either stapled on the edge nearest rollers 24, 26, or the sheets of the booklet may remain loose, that is not secured together.

When a booklet is finished, gate 34 is lowered and the booklet ordinarily is removed from tray 32 and deposited in a tote tray 36 located beneath and to the side of the assembly tray. The booklet B can be transported from the assembly tray to the tote tray by means of a pair of jaws and a transport arm as described generally in connection with FIGS. 3 and 4 and as described in more detail in the before-mentioned U.S. Pat. No. 4,134,672.

As discussed hereinbefore, some prior finishing apparatus have an opening through which a machine operator can remove a finished booklet from a collection station while additional booklets are being produced. Thus the machine operator can make certain that the booklets being produced were in correct sequence, had covers if desired, etc. As illustrated in FIG. 1, finisher 20 has a housing 38 and a door 40 hinged at 42 to the housing. The door normally is closed, however the door can be opened by pulling on a handle 44 so that the operator has access to the tote tray 36. The door 40 may be provided with a mechanical/electrical interlock which will stop operation of the duplicator 10 and finisher 20 in the event the operator opens the door while finishing operations are in progress. A door interlock effectively prevents examination of a completed booklet until a complete job run is finished unless means are provided for removing a booklet from the housing automatically during operation of the finisher without opening the door. Such is accomplished in accordance with the apparatus of the present invention.

Referring again to FIG. 2 of the drawings, a slot or opening 46 in door 40 defines a passage for a booklet B from inside of the finishing apparatus to a position where the booklet is accessible from outside the apparatus by the machine operator. Means can be provided outside the housing 38 for receiving and holding a booklet delivered through slot 46. By way of example, a tray 48 is formed on the outside of door 40 by a plate-like member 50 that is secured to the door beneath the slot 46. Member 50 has a curved upper portion 52 extending above slot 46 and shaped to deflect the booklet B exiting the slot 46 downwardly toward the lower portion of the tray. As illustrated in FIG. 1, the width of tray 48 may be narrower than the width of a booklet B so that one end of the booklet extends beyond the sides of the tray to thereby facilitate removal of the booklet from the tray.

Means are provided for engaging a booklet after it is assembled in tray 32 and for delivering the booklet into and through the slot 46 and then into the tray 48. The engaging and delivering means illustrated in FIG. 2 comprises a pair of drive shafts 56 and 58 located in a plane beneath tray 32 and coupled to a drive shaft 60 by a belt and pulley arrangement generally designated 62. Shaft 60 can be driven from a motor or other suitable power source (not shown). Drive rollers 64 on shaft 56 extend upwardly through notches or openings in the tray 32 so that they are engageable with the bottom surface of a booklet B assembled in the tray. Similarly, a plurality of drive rollers 66 are provided on shaft 58, only one such roller being illustrated in FIG. 2. Idler rollers 68 on a shaft 70 are located above the drive rollers 66 and jointly define therewith a nip for receiving a booklet and driving it toward the slot 46 as shown in dotted lines in FIG. 2. Similarly, idler rollers 72 are provided on a shaft 74 to form with drive rollers 64 a nip for driving the booklet from tray 32 into the nip defined by rollers 66, 68. Shaft 74 is mounted on lever arms 76, the arms being pivoted at 78 to supports designated 80. This allows the shaft 74 and nip rollers 72 to be swung between a lowered position, shown in solid lines, and an elevated storage position, as illustrated in phantom in FIG. 2.

When a booklet B is to be driven through slot 46 to the outside of the finishing apparatus, levers 76 are swung to their solid line position to thereby bring the nip rollers 72 into a position over the drive rollers 64, and shaft 60 is driven to thereby drive the drive rollers 64 and 66. As a result a booklet B is driven from the nip defined by rollers 64, 72 into the nip defined by rollers 66, 68 and then through slot 46 and delivered into the tray 48 at the outside of the machine. Idler rollers 72 can be swung between their two positions by any suitable mechanism, such as by a solenoid 82 shown coupled diagramatically to the lever 76.

During normal operation of the finisher the nip rollers 72 are in the elevated position shown in phantom in FIG. 2. As copy sheets are produced by duplicator 10 they are delivered to the finishing apparatus and travel along the guide 22 and between the pairs of rollers 22, 26 so that they are delivered into tray 32 where they are jogged into alignment. When all sheets of a set of sheets have been received in tray 32, the sheets are stapled together (or left unstapled). If the operator has not programmed the apparatus for delivery of the finished set to the outside of the machine by providing proper input data to the operator control panel 14, then the finished booklet is removed from tray 32 and delivered to the tote tray 36 in the conventional manner as explained in more detail in the beforementioned U.S. Pat. No. 4,134,672. On the other hand, if the operator has programmed the apparatus through control panel 14 to deliver a finished booklet to tray 48, then, when the booklet B is completely finished in tray 32, the solenoid 82 is energized to swing the nip rollers 72 into their solid line position. At this time, shaft 60 is driven to thereby drive rollers 64 and 66. The booklet is driven by rollers 64, 72 from its position in the tray 32 to the right as viewed in FIG. 2 and into the nip defined by rollers 66, 68. These rollers, in turn, drive the booklet through the slot 46 and into the tray 48 where it is easily accessible to the machine operator. As soon as the booklet is being driven by rollers 66, 68, solenoid 82 can be operated to drive the nip rollers 72 to the elevated position shown in phantom. When the booklet has cleared tray 32, sheets of the next booklet can be delivered to the tray for formation of another booklet. The booklet delivered to tray 48 can be the first booklet produced, or any subsequent booklet.

Figure 3:
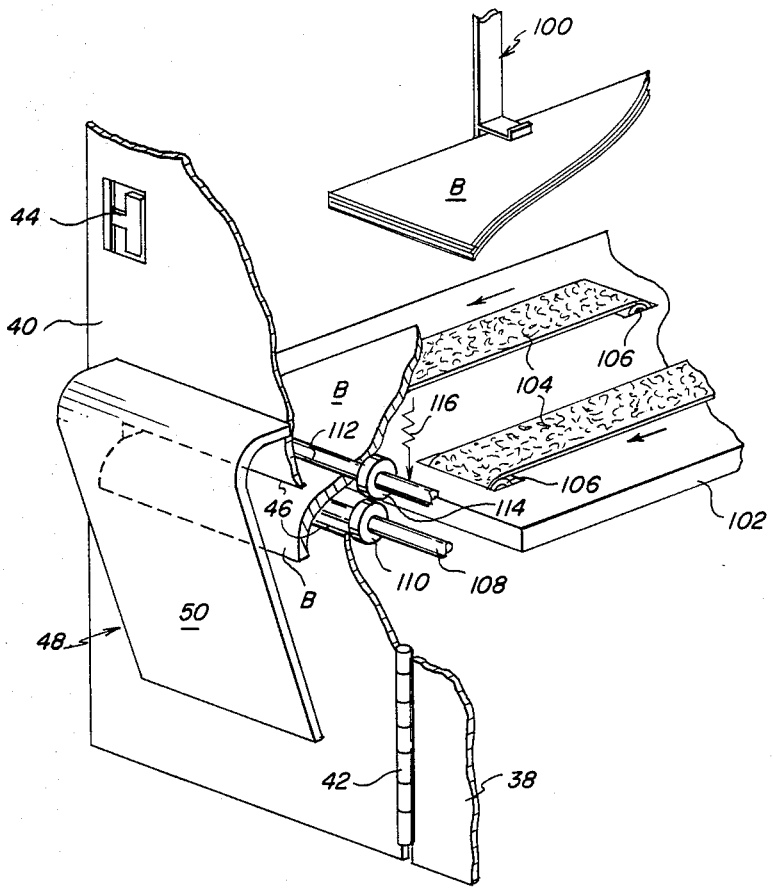
FIG. 3 is an enlarged, fragmentary perspective illustrating a second embodiment of the apparatus of the invention wherein a finished booklet is fed from a tote tray directly to a position outside the finishing apparatus.

FIG. 3 of the drawings illustrates another embodiment of the apparatus. In this embodiment booklets B formed in the assembly station 30 in a manner explained hereinbefore are delivered onto a tote tray 102 by a booklet transport mechanism generally designated 100. Mechanism 100 can be the same or similar to the booklet transport mechanism disclosed in U.S. Pat. No. 4,134,672. Tote tray 102 is of somewhat different construction than that illustrated at 36 in FIG. 2. More specifically, the tote tray has on its upper surface one or more drive belts 104, the upper reach of which extends along the upper surface of the tote tray. The drive belts can be trained around suitable rollers 106 with one roller for each drive belt being driven so that the belts can be moved toward the door 40 of the binder as indicated by the arrows in FIG. 3. The upper surface of the drive belt 104 is substantially aligned with the lower portion of the slot 46 in the door 40. Between slot 46 and the tote tray 102 are a drive shaft 108 having a plurality of drive rollers 110, and an idler shaft 112 having nip rollers 114. The idler rollers or shaft can be urged downwardly toward rollers 110 by a spring as shown diagramatically at 116. The nip between rollers 112 and 114 is located relative to the tote tray and the slot 46 so that a booklet B driven from the tote tray by belts 104 is received in the nip between the rollers 110, 114. The rollers then drive the booklet through the slot 46 and into the tray 48 on the outside of the finisher housing.

In operation of the FIG. 3 embodiment, a booklet B delivered to the tote tray 102 will be deposited directly on the drive belts 104. If the operator has indicated through the operator control panel 14 that a finished set is to be delivered to tray 48, the belts 104 will be driven in the direction indicated by the arrows. Thus upon receipt of the booklet B into the tote tray the booklet is immediately driven into the nip between rollers 110, 114 for delivery through slot 46 into the tray 48. If the operator has not requested delivery of a booklet into tray 48, the booklets are simply stacked in the tote tray on top of the belts 104 and removed at the end of a production run by opening door 40.

Figure 4:
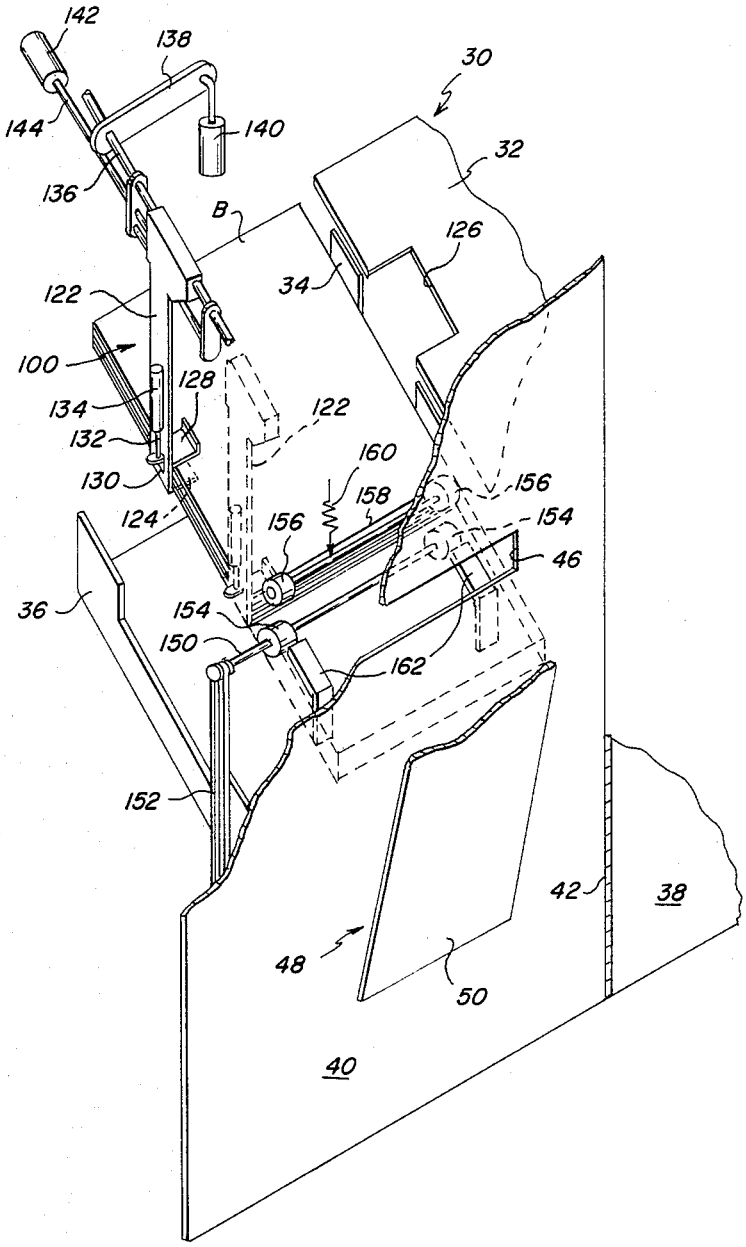
FIG. 4 is an enlarged fragmentary perspective view illustrating a third embodiment of the invention wherein a finished booklet assembled in an assembly tray is removed from the finisher before delivery to a tote tray.

FIG. 4 illustrates an embodiment of the present invention wherein booklets B are delivered through slot 46 to tray 48 after the booklets have been removed from the assembly station 30 and before they are delivered to the tote tray 36. As mentioned before, a booklet transport mechanism 100 as disclosed in U.S. Pat. No. 4,134,672 can be used for removing sheets from the assembly tray and delivering them to the tote tray 36. In accordance with this embodiment of the invention mechanism 100 is used for deliverying a booklet into passage 46.

Transport mechanism 100 comprises a transport arm 122 having at its lower end a fixed jaw 124 that is adapted to fit under a side edge of booklet B when the booklet is in the assembly tray 32. A notch or opening 126 in tray 32 accommodates the fixed jaw 124. A movable jaw 128 is positioned above the fixed jaw 124 and a portion of jaw 128 projects through a slot 130 in arm 122. The projecting end portion of the movable jaw 128 is connected to a rod 132 of a pneumatic cylinder 134 mounted on arm 122. Thus jaw 128 can be moved toward and away from jaw 124 in response to operation of the cylinder 134. This permits a booklet to be gripped between the jaws so that it can be transported from tray 32 for delivery to tote tray 36 or through slot 46.

Arm 122 is mounted on a pivot shaft 136 so that the arm is rotated in response to rotation of the shaft. Arm 122 is also movable in an axial direction along the shaft for a reason to be explained later. Shaft 136 is mounted for rotation about its axis. A lever arm 138 has one end portion secured to shaft 136 and the other end portion of the lever arm is coupled to the rod of a pneumatic cylinder 140. Operation of cylinder 140 effects movement of lever arm 138 and shaft 136 in each of two directions. Thus in response to operation of cylinder 140 the arm 122 and jaws 124, 128 can be moved toward the assembly tray 32. Then a booklet in the tray is gripped between the jaws by operation of cylinder 134. Movement of the jaws in the opposite direction by operation of cylinder 140 brings the booklet into a position over tote tray 36 where the booklet can be released (by operation of cylinder 134) to thereby deliver the booklet to the tote tray 36.

As mentioned earlier, arm 122 is movable axially along shaft 136. Such axial movement can be effected by a pneumatic cylinder 142 having a rod 144 that is coupled to the arm 122 in any suitable manner. By operation of cylinder 142, arm 122 is moved in an axial direction when the arm is swung away from tray 32 and in a position over tote tray 36. As disclosed in the beforementioned U.S. Pat. No. 4,134,672, such axial motion can be provided in order to offset stack adjacent booklets in tray 36. Thus if one booklet B is removed from assembly tray 32 by arm 122 and then released when the arm is over the tray 36, without axial movement of the arm, and the next booklet is first swung to a position over the tray and then the arm is moved axially along shaft 136 before release occurs, such will result in offset stacking of the booklets in the tray 36. By way of example, the transport arm can be moved about two inches along shaft 136 when offset stacking is desired.

In accordance with this embodiment of the invention, axial movement of arm 122 along shaft 136 is used for feeding a completed booklet through the slot 46 in the tray 48. More specifically the slot 46 is aligned with the position occupied by a booklet B when it is gripped by jaws 124, 128 and swung into the position over the tray 36. By providing a longer stroke for cylinder 142, arm 122 can move toward door 48 by a distance sufficient to feed a completed booklet into apparatus for engaging and driving the booklet through the slot 46.

A drive shaft 150 is provided above tote tray 36 and near the slot 46. Shaft 150 can be coupled to a source of power by a drive belt 152. Shaft 150 is effective to drive a plurality of drive rollers 154. Nip rollers 156 above rollers 154 are mounted on a shaft 158 and are urged toward the drive rollers by biasing means illustrated diagramatically at 160. Rollers 154, 156 jointly define a nip adapted to receive a booklet B moved toward slot 46 by arm 122. A booklet thus received between the pairs of rollers is driven by rollers 150 toward slot 46 for delivery into the tray 48. Suitable guide members 162 can be positioned along the sheet path leading to the slot in order to support the booklet as it is driven toward the slot. Such guide members can be provided on both sides of rollers 154 if desired, and may also be provided along similar paths leading to slot 46 in other embodiments of the invention disclosed herein.

In operation of the FIG. 4 embodiment, booklets produced in assembly station 30 are removed from the station by operating cylinder 134 to grip the booklet between jaws 124, 128, lowering gate 34, and then energizing cylinder 140 to swing shaft 136 and thus arm 122 away from the assembly station to a position over the tote tray 36 as illustrated in solid lines in FIG. 4. At this time, booklet B can be either released for delivery to tray 36 or fed through slot 46, depending on how the apparatus has been programmed by the machine operator through the control panel 14. When the apparatus is to deliver the booklet through the slot 46, then cylinder 142 is operated to drive arm 122 axially along shaft 136 to move the arm to the dotted line position illustrated in FIG. 4. As such movement occurs the leading end of the booklet B is fed into the nip defined by rollers 154 and 156. The rollers then are effective to drive the booklet across guides 162 and through slot 46 into the tray 48. As soon as the booklet is delivered into the nip between the rollers 154, 156, cylinder 134 is deenergized to release the booklet and permit its advancement by the rollers 154, 156. Then cylinder 142 returns arm 122 to its solid line position and, as soon as the booklet clears the arm, the arm is returned to its position adjacent to tray 32 so that it is available to transport the next booklet assembled in the station 30.

Figure 5:
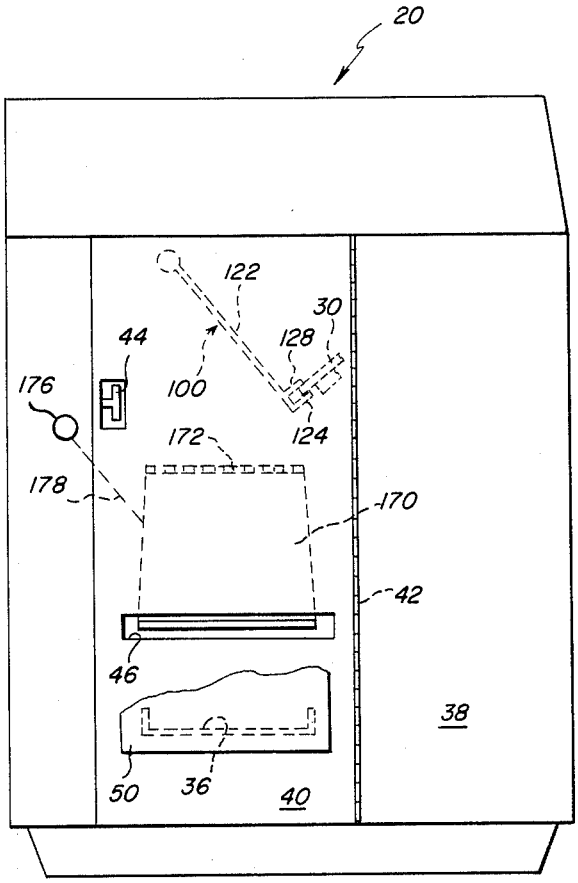
FIG. 5 is an elevation view of a fourth embodiment of the apparatus of the invention.

The embodiment of the invention illustrated in FIG. 5 is similar in many respects to the FIG. 4 embodiment. In FIG. 5, however, the means for engaging the booklet after it is assembled in the assembly station and for delivering it into the slot 46 at the front of the finisher comprises a movable guide or tray 170 that is hinged at 172 to a suitable support inside the housing 38 of the finisher. When booklets are to be furnished to tote tray 36, the tray 170 is located in a generally vertical, non-diverting position at the rear of the finisher where it is not in the path of booklets being removed from assembly station 30 by the transport mechanism 100 and delivered to the tote tray 36. However, the tray can be swung about hinge 172 to a booklet diverting position, illustrated in solid lines in the drawings, where it lies between the tote tray and the transport mechanism 100 when such mechanism is swung to its position over the tote tray for release of a booklet. When in the diverting position, the forward end of tray 170 is located relative to slot 46 so that a booklet dropped onto the upper tray surface by the transport mechanism 100 will slide along the surface and be delivered through slot 46 into the tray 48 on the outside of the housing. Guides adjacent slot 46, such as the guides shown at 162 in FIG. 4, can be provided for guiding a booklet from tray 170 into the slot 46.

The tray 170 can be moved from its non-diverting position at the back of the housing to its diverting position under the transport mechanism 100 by any suitable means. For example, a booklet access knob or handle 176 can be provided at the front of the binder housing 38 and coupled to tray 170 by a mechanical or electrically operated mechanism as shown diagramatically at 178. The tray can be returned from its diverting position to its non-diverting position by gravity, a return spring (not shown) or other suitable means. Also, the tray can be moved between its positions by electrically operated apparatus controlled from the operator control panel 14 of the duplicator 10.

With each of the embodiments of the invention described hereinbefore the apparatus can be operated to produce finished booklets while the door 40 remains in a closed position, thereby avoiding the likelihood that the machine operator might become injured by reaching inside the machine to remove a finished set during operation of the apparatus. At the same time, a finished set is available to the operator through the slot 46 so that the operator can check the operation of the apparatus and make certain that the booklets being produced are correct in all respects. In most instances the operator will want to check the first booklet produced, and all embodiments of the invention are capable of feeding the first booklet produced to the tray 48 for examination by the operator. In addition, the embodiments of the invention illustrated in FIGS. 2, 4 and 5 also permit delivery through slot 46 of any one (or more) of the booklets produced during a production run. For example, the first booklet, the fifth booklet, or each tenth booklet might be delivered through slot 46, depending on the operators input to the apparatus logic and control unit through control panel 14.

Programming of the logic and control unit to deliver one or more booklets into tray 48 can be effected at the time the operator sets up the machine to run a particular job. Also, a command calling for delivery of a booklet to tray 48 can be sent to the logic and control unit while the apparatus is operating. The operator input to the logic and control unit can be through the control panel 14, as described previously, or through a separate control panel located, for example, on the finisher 20.

If desired the logic and control unit can be pre-programmed so that one (or more) booklets are delivered to tray 48 anytime the output of a job run on the copier/duplicator is directed to the finisher. Such a pre-programmed arrangement will reduce operator set up time and simplify operator input. When the logic and control unit is pre-programmed, provision can be made for allowing the operator to cancel delivery of a booklet to tray 48 by an appropriate input to the operator control panel on the copier/duplicator or on the finisher.

The apparatus of the invention has been described specifically in connection with a stapler type finisher as disclosed, for example, in the beforementioned U.S. Pat. No. 4,134,672. However, it will be understood that apparatus for engaging a booklet and delivering it through a passage to a tray outside the machine can also be utilized with other types of apparatus, including, for example an adhesive binder as disclosed in the beforementioned U.S. Pat. No. 4,473,425, issued Sept. 25, 1984 in the names of R. C. Baughman et al and entitled BINDING APPARATUS AND METHOD.

The invention has been described in detail with particular reference to the preferred embodiments thereof, but it will be understood that variations and modifications can be effected within the scope and spirit of the invention.

I claim:

1. In apparatus for receiving a plurality of sheets and producing booklets, the apparatus having (1) an assembly station inside the apparatus where a set of sheets are assembled together to from a booklet, (2) a collection station inside the apparatus for receiving booklets delivered from the assembly station, and (3) a housing substantially enclosing the assembly station and the collection station, the housing having a door movable between (i) a closed position for limiting access by an operator to the collection station and (ii) an open position for permitting an operator to remove booklets in the collection station, the improvement comprising:

means defining a passage for a booklet from inside the housing to a position spaced from the stations and where the booklet is outside the housing and accessible to an operator without opening the door; and means for engaging a booklet after it is assembled in the assembly station and for delivering the booklet into the passage without moving the door from its closed position to its open position.

2. The invention as set forth in claim 1 wherein the engaging and delivering means comprises a plurality of drive members located relative to the assembly station for driving a booklet from the assembly station into the passage.

3. The invention as set forth in claim 1 wherein the engaging and delivering means comprises a plurality of drive members located relative to the collection station for driving a booklet from the collection station into the passage.

4. The invention as set forth in claim 1 wherein the engaging and delivering means comprises means adjacent the passage for driving a booklet through the passage, and means for gripping a booklet in the assembly station and feeding the booklet into the driving means.

5. The invention as set forth in claim 1 wherein the engaging and delivering means comprises a tray mounted for movement between first and second positions relative to the passage, the assembly station and the collection station, the tray when in its first position being effective to divert a booklet toward the passage after the booklet is assembled in the assembly station and thus prevent the booklet from being delivered to the collection station, and the tray when in its second position being in a non-diverting position so that it does not interfere with delivery of booklets from the assembly station to the collection station.

6. In apparatus for producing finished booklets from sets of sheets fed seriatim to the apparatus, the apparatus having (1) a housing, (2) an assembly station inside the housing where a set of sheets can be assembled and secured together to form a booklet, (3) a collection station inside the housing for receiving a plurality of finished booklets from the assembly station, and (4) means for transporting a finished booklet along a path from the assembly station to the collection station, the housing having a door movable between an open position and a closed position, the door when in its closed position being effective to limit access by an operator to the assembly station and the collection station; the improvement comprising:

means on the outside of the housing for holding a booklet;

an opening in the housing defining a passage for a booklet from inside the housing to the holding means; and means for engaging a booklet after it is produced in the assembly station and for delivering the booklet through the passage into the holding means without moving the door from its closed position.

7. The invention as set forth in claim 6 wherein the opening is adjacent the assembly station, and the engaging and delivering means comprises a plurality of drive and idler rollers for driving a booklet from the assembly station and toward the opening.

8. The invention as set forth in claim 6 wherein the collection station comprises a tray on which booklets are deposited by the transporting means, and the engaging and delivering means comprises at least one drive belt in the collection station operable when driven to drive a booklet out of the tray and toward said opening.

9. The invention as set forth in claim 8 wherein the engaging and delivering means further comprises a plurality of rollers between the drive belt and the opening for receiving a booklet driven from the tray by the belt and for feeding the booklet through the opening.

10. The invention as set forth in claim 6 wherein the transporting means comprises an arm, means for rotating the arm between first and second positions, means on the arm for (1) gripping a booklet in the assembly station while the arm is in its first position and (2) releasing the booklet over the collection station when the arm is in its second position, and the engaging and delivering means comprises (1) a plurality of nip drive rollers adjacent the opening and (2) means for moving the arm toward the nip drive rollers while a booklet is held by the gripping means, thereby to feed a booklet into the nip drive rollers for delivery by such rollers through the opening.

11. The invention as set forth in claim 6 wherein the transporting means comprises means for moving a booklet to a position above the collection station and then releasing the booklet so that it can be delivered into the collection station under the influence of gravity, and the engaging and delivering means comprises a tray in the housing mounted for pivotal movement between (1) a non-diverting position outside the path for booklets between the assembly station and the collection station and (2) a booklet diverting position wherein a surface of the tray is located relative to the housing opening and the path for a booklet released by the transport means so that a released booklet is deflected from the path to the collection station and travels along such surface toward the opening.

12. In apparatus for receiving a plurality of sheets and producing booklets, the apparatus having (1) an assembly station inside the apparatus where a set of sheets are assembled together to form a booklet and (2) a collection station inside the apparatus for receiving booklets delivered from the assembly station, the improvement comprising:

booklet holding means spaced from the stations and located in a position that is accessible from outside the apparatus;

means for delivering a booklet from the assembly station either (1) to the collection station or (2) to the holding means; and programmable control means associated with the delivering means for selectively operating the delivering means to deliver booklets either to the collection station or to the holding means.

13. The invention as set forth in claim 12 wherein the delivering means is located relative to the assembly station for driving a booklet from the assembly station to the holding means.

14. The invention as set forth in claim 12 wherein the delivering means is located relative to the collection station for driving a booklet directly from the collection station to the holding means.

15. The invention as set forth in claim 12 wherein the delivering means comprises drive means between the assembly station and the holding means, and means for gripping a booklet in the assembly station and feeding the booklet into the drive means.

* * * * *